United States Patent [19]

Clavin

[11] 4,132,104

[45] Jan. 2, 1979

[54] METHOD AND APPARATUS FOR BENDING COATED PIPE INCLUDING HEATING THE PIPE COATING BY RESISTANCE HEATING

[75] Inventor: Edward A. Clavin, Houston, Tex.

[73] Assignee: Midcon Pipeline Equipment Co., Houston, Tex.

[21] Appl. No.: 886,631

[22] Filed: Mar. 15, 1978

Related U.S. Application Data

[63] Continuation-in-part of Ser. No. 735,182, Oct. 26, 1976, abandoned.

[51] Int. Cl.[2] ..... B21D 7/16

[52] U.S. Cl. ..... 72/342; 72/369; 72/DIG. 12

[58] Field of Search ..... 72/342, 369, DIG. 12; 219/7.5, 153, 154

[56] References Cited

U.S. PATENT DOCUMENTS

| | | | |
|---|---|---|---|
| 2,007,775 | 7/1935 | Smith | 72/DIG. 12 |
| 2,893,459 | 7/1959 | Kosek | 72/DIG. 12 |
| 3,105,537 | 10/1963 | Foster | 72/369 |
| 3,251,974 | 5/1966 | Seyfried | 219/7.5 |

FOREIGN PATENT DOCUMENTS

| | | | |
|---|---|---|---|
| 969458 | 6/1975 | Canada | 72/342 |
| 2276158 | 1/1976 | France | 72/342 |

*Primary Examiner*—Lowell A. Larson

[57] ABSTRACT

Method and apparatus for bending coated pipe including heating a specific area of the pipe coating by resistance heating to prevent damage at all areas of the pipe coating during bending of the pipe. The pipe bending equipment includes an upper bending die, and a lower pin up shoe and a lower strongback. The strongback has resistance heating means in a recess which is positioned over a specific area of the upper surface of the strongback, for heating the pipe coating prior to bending of the pipe. By heating of a relatively small specific area of the pipe coating, damage to the entire area of the coating is avoided.

24 Claims, 9 Drawing Figures

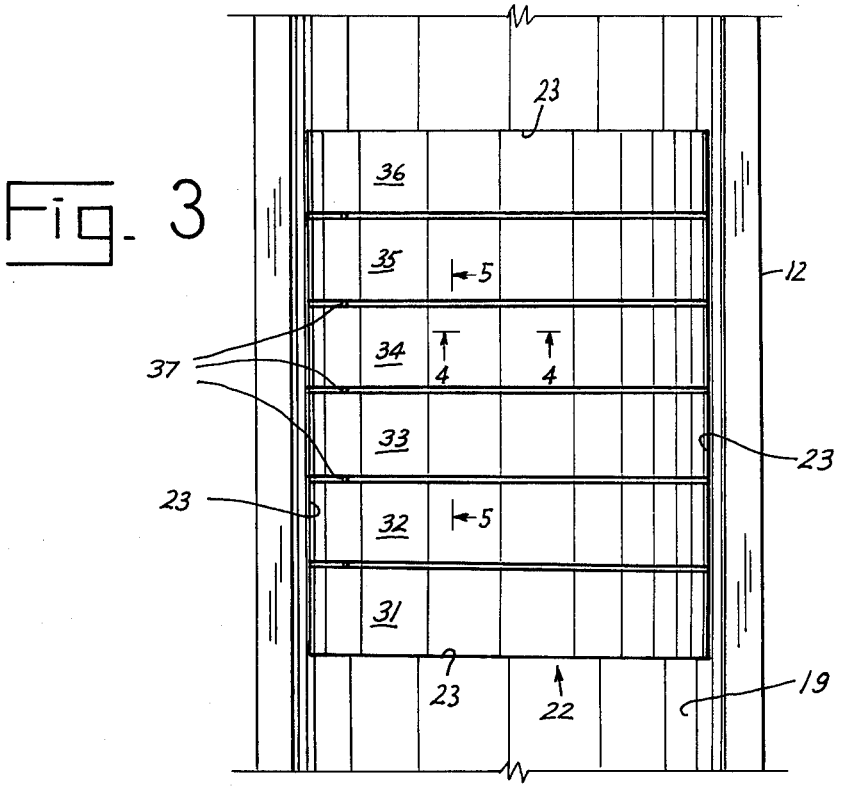
Fig. 3
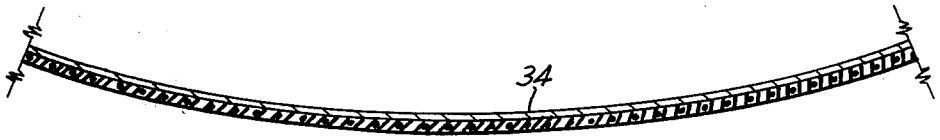
Fig. 4
Fig. 5
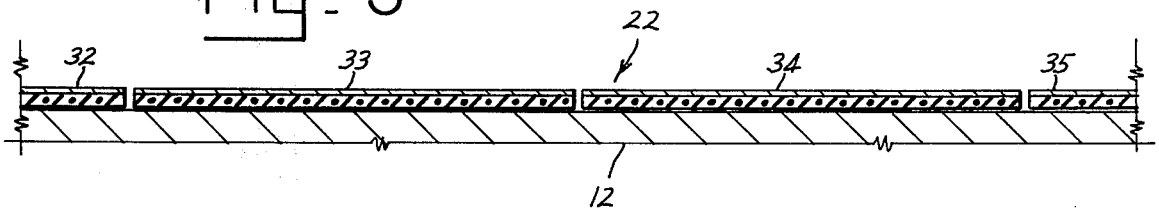

METHOD AND APPARATUS FOR BENDING COATED PIPE INCLUDING HEATING THE PIPE COATING BY RESISTANCE HEATING

This application is a continuation-in-part of application Ser. No. 735,182, filed Oct. 26, 1976, now abandoned.

BACKGROUND OF THE INVENTION

Bending of coated pipe of relative large diameter presents a number of problems. The coating is bonded to the outer surface of the pipe wall, and when the pipe is bent in conventional bending equipment high compressive force is imposed against the outer surface of the coating at the outside of the bend by the movable bending shoe, which is usually called the strongback. The metal of the pipe is stretched at the outside of the bend and the coating must stretch accordingly if it is to remain properly disposed on the pipe surface. The coating, highly compressed between the strongback and the pipe wall is not free to stretch uniformly. During bending of the pipe, the longitudinal stresses imposed on the coating cause tearing and rupture of the coating, the tears usually being generally arcuate about the lower side of the pipe at the outside of the bend and being spaced along the length of the bend.

It is known that heating of some pipe coatings during pipe bending will reduce or eliminate tearing and rupturing of the coatings, but a satisfactory method for heating the coating on the pipe has not heretofore been found.

One reason that heating of the pipe coating has not with any dependability prevented damage to the pipe coating is that it has not heretofore been realized exactly which area or areas of the coating should be heated prior to bending. Use of resistance heating for preventing damage to the pipe coatings during bending of pipes has never been successfully accomplished, and the prior art is devoid of any specific disclosure relating thereto. Canadian Pat. No. 969,458, and corresponding French Pat. No. 2,276,158, briefly mention that resistance heating might possibly be employed, and that the use of polytetrafluorethylene coatings on the resistance heaters has been envisaged, but these patents do not suggest that resistance heating of pipe coatings, with or without polytetrafluorethylene coatings on the resistance heaters, has ever been accompllished, and do not disclose any guidelines or specifications for doing so, beyond a bare suggestion.

This invention provides methods and apparatus whereby resistance heaters, properly positioned with respect to a bend, may be used successfully for bending coated pipe without damage to the pipe coating on a dependable and consistent basis.

SUMMARY OF THE INVENTION

According to the invention, the pipe coating at the outside of the bend is heated directly by resistance heating apparatus disposed at a specific area with respect to the location at which the bend is to be made. The resistance heater or heaters are energized prior to making the bend, and are disposed in contact with the coating or relatively closely adjacent thereto in a manner such that the coating is rapidly heated and made more pliant just prior to the time that the pipe is to be bent. The resistance heater equipment is disposed over the area of coating which will be more highly stressed during bending, according to certain principles for determining the location of the high stress area. When the pipe is bent, the preheated coating is stretched as the pipe is bent, resulting in the elimination of tears and ruptures of the coating during bending. Furthermore, separation of the coating from the pipe during bending is eliminated.

A principal object of the invention is to provide improved methods and apparatus for bending coated pipe. Another object of the invention is to provide such methods and apparatus wherein the pipe coating is heated by resistance heater apparatus at the outside of the bend to prevent damage to the coating during bending. Another object of the invention is to provide such methods and apparatus wherein the pipe coating area to be heated by resistance heating to prevent coating damage is properly located. Still another object of the invention is to provide such methods and apparatus which are dependable and economical.

Other objects and advantages of the invention will appear from the following detailed description of preferred embodiments thereof, reference being made to the accompanying drawings.

BRIEF DESCRIPTIONS OF THE DRAWINGS

FIG. 3 is a top view of the strongback shown in FIG. 2.

FIG. 4 is a partial enlarged transverse cross section taken at line 4—4 of FIG. 3.

FIG. 5 is a partial enlarged cross section taken at line 5—5 of FIG. 3.

DESCRIPTION OF THE PREFERRED EMBODIMENTS

Figure 1:
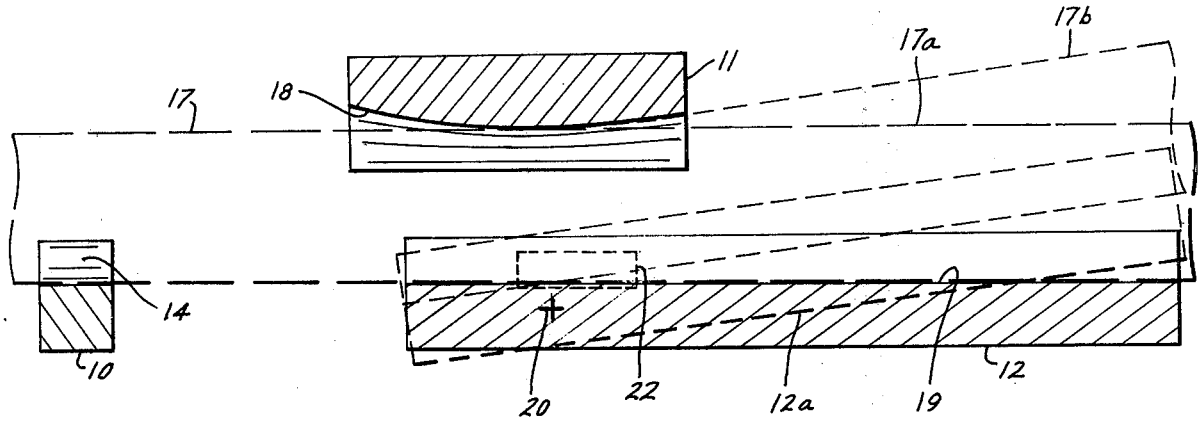
FIG. 1 is a schematic vertical cross section showing a preferred method and apparatus according to the invention.

Referring now to the drawings in detail, and first to FIG. 1, a typical pipe bending apparatus for use in bending pipe of relatively large diameter, for example, pipe from about twelve to sixteen inches in diameter up to sixty inches in diameter or larger, has a pin up shoe 10, a bending die 11, and a strongback 12. The pin up shoe 10 has an upwardly facing longitudinal recess 14 of semicircular cross section adapted to engage the lower side of the outer periphery of a pipe 17. The bending die 11 has a downwardly facing longitudinal recess 18 having semicircular cross sections to also fit the pipe diameter, the recess 18 being curved convexly downward from end to end as shown in FIG. 1 of the drawings. The strongback 12 has an upwardly facing longitudinal recess 19 having semicircular cross sections over its length, the recess 19 extending the full length of the strongback. To bend a pipe, the strongback is pivotally moved about a transverse axis such as the axis indicated by the cross referred to by reference numeral 20, from its horizontal position to an angular position 12*a*, being the righthand end of the pipe from position 17*a* to or toward an angular position 17*b*. The bend of pipe 17 indicated at 17*b* in FIG. 1 is the only bend to which the pipe is shown to have been subjected. Pipe bending will usually be commenced at or near the lefthand end of a pipe 17 as depicted in FIG. 1, and the bending will proceed stepwisely from the first bend at the lefthand end of the pipe toward the righthand end of the pipe.

Since the invention is not concerned with the specific forms of the dies, the dies shown throughout the drawings of this application vary in form, and the complete bending machine structure is not shown. Bending machines of a variety of designs are known in the art, of which the skilled artisan will be aware.

Still referring primarily to FIG. 1 of the drawings, the strongback 12 has, at a portion of its upper surface, a resistance heating element 22. Heating element 22 is of sheet or blanket form curved to fit a prescribed area of the upwardly facing recess 19, and the pipe 17 disposed therein. The heating element 22 is connected to a suitable electrical source by conductors which are not shown in FIG. 1, in order that the element may be heated for the heating of the coating on the pipe 17. Because of drawing size limitations, the coating is not depicted in FIG. 1, but the entire outer surface of pipe 17 is coated with a coating material which will be heated by the resistance heating element 22 over an area in which the pipe coating will be highly stressed when the pipe is bent. The pipe portion to be bent is disposed in contact with or in close proximity to the heating element 22 with the strongback 12 in its horizontal position. Before each pipe bending operation, heating element 22 is heated to a temperature which will heat the coating to a temperature at which the coating will be softened so that it will stretch and bend as the pipe is bent without tearing or rupturing. The proper coating heating temperature and the time required to heat the coating to such a temperature will be determined by the natures of the coating and of the heating element or elements.

Referring now also to FIGS. 2–5, the heating element 22 is disposed in a relieved or recessed portion 23 of a strongback 12. Electrical conductor cable 25 is connected to the heating element 22 and extends to a suitable control apparatus 27 to which electrical energy is delivered by electrical conductor cable 28. The heating element 22 has a thickness equal or about equal to the depth of recess 23 so that the heating element will be flush with the inner surface of strongback 12 and will engage or be closely disposed with respect to the pipe 17 nested in recess 19 of strongback 12. Pipe 17 has on its outer surface a coating 24 in the form of a uniform continuous layer of plastic or resin which is softened by heating. Coating layer 24 may be formed of, for example, an epoxy material such as SCOTCH COAT 202, which is a product of Minnesota Mining and Manufacturing Company. The area of pipe coating 24 exposed to the heating element 22 will be heated by operation of the heating element to make the coating softer and more deformable during the bending of the pipe.

Figure 2:
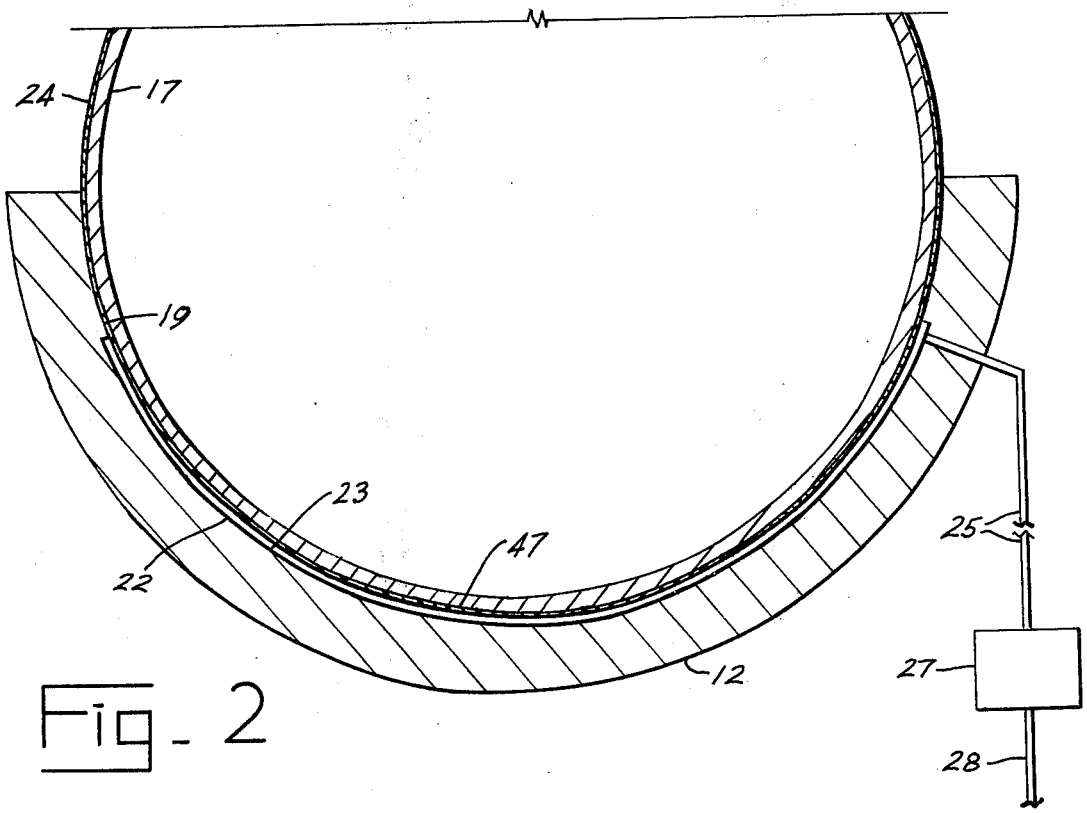
FIG. 2 is a schematic vertical cross section taken transverse to the length of a strongback of modified form according to the invention.

Referring to FIG. 3 of the drawings, the heating element 22 may consist of a single sheet-like element, sized to fit recess 23, as shown in FIGS. 1 and 2, or may be made up of a plurality of heating element strips 31–36 interconnected by conductors 37. Alternatively, each heater may be separately connected to the electrical power source. One advantage of making of the heating element 20 in the form of plural heating element strips is that in case of damage to one or more elements only the damaged elements need be repaired or replaced. In addition, the strip type heating elements are easier to handle and install than would be a larger heating element of a single sheet form. Furthermore, the heating elements of strip form are readily obtainable as off-the-shelf items so need not be specially manufactured for their purpose in accordance with this invention.

Figure 6:
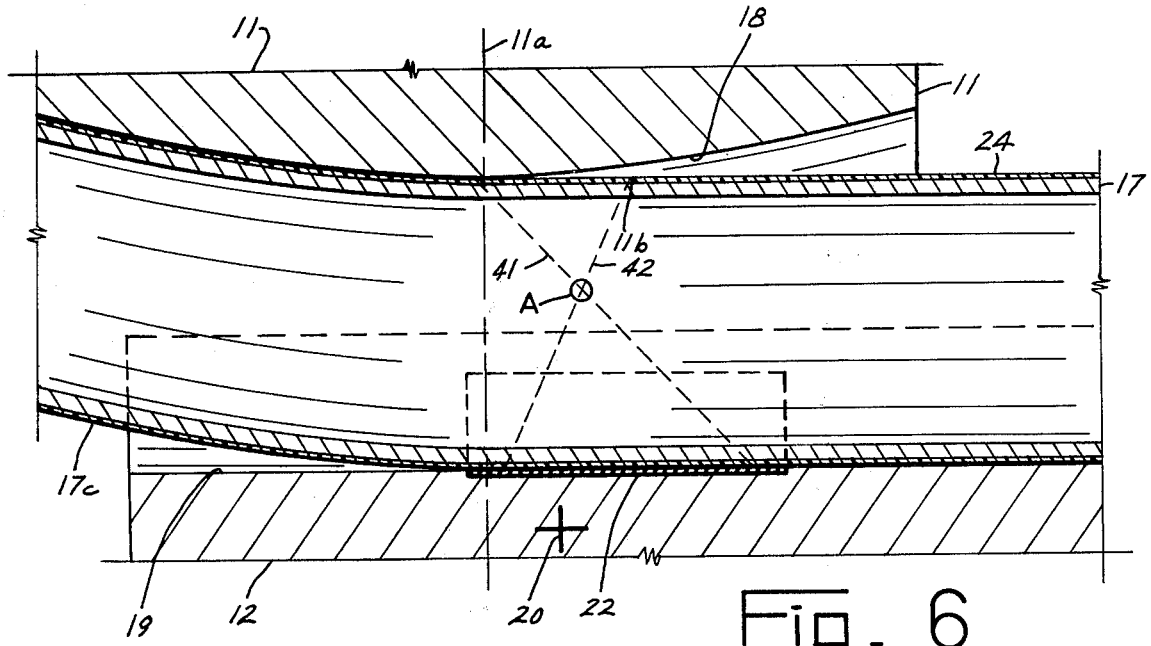
FIG. 6 is an enlarged longitudinal cross section illustrating the method and apparatus for bending pipe according to the invention.
Figure 7:
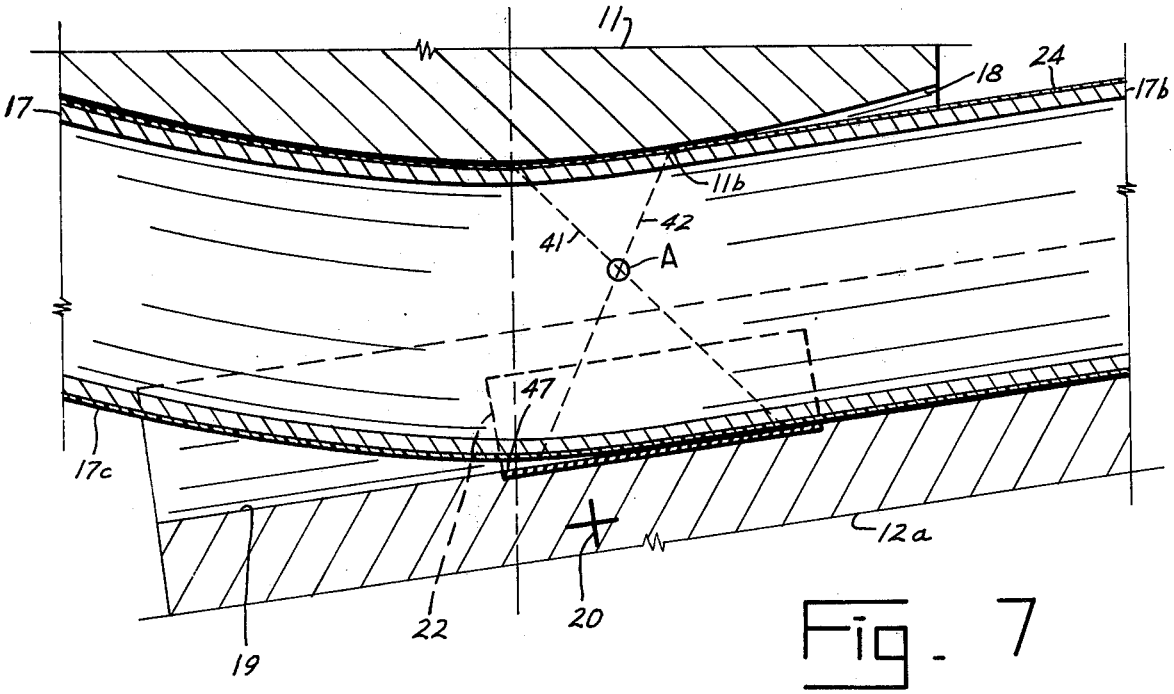
FIG. 7 is a longitudinal vertical cross section similar to FIG. 6 showing the strongback postion following the making of a bend according to the invention.

Referring now also to FIGS. 6 and 7 of the drawings, the pipe 17 is shown to have the coating 24 adhered or bonded to its outer surface. Pipe 17 is shown in FIG. 6 to be bent upwardly at its lefthand portion 17*c* as the result of previously bending operations. As stated earlier, bending is done in a sequence of side-by-side bends over a length of the pipe, from left to right along the length of the pipe, and not in a single bending operation to form the entire length of the bend at one time.

The bending die 11, FIG. 6, is in contact with the upper side of coated pipe 17 at the left of the center of the bending die the centerline of the die being indicated by reference numeral 11*a*. The strongback 12 is engaged with the pipe to the right of the intersection of centerline 11*a* with the strongback. Heating element or elements 22 engage the pipe coating 24 or are closely disposed thereto over the full area of the heating element or elements 22. The lefthand portion of pipe 17 at 17*c* is supported by a pin up shoe 10, as in FIG. 1, the pin up shoe not being shown in FIGS. 6–7. With the heating element turned on and left in contact with or adjacent to the coating for a sufficient period of time, the coating is directly heated to a temperature which will permit bending of the pipe without rupturing of the coating. After the coating is sufficiently heated, the strongback is moved to its position 12*a* shown in FIG. 7 to bend an additional length of the pipe to the right of the previously bent pipe portion 17*c*. As the pipe is bent, the coating stretches and gives sufficiently that it is not ruptured or torn during the bending operation, and the bond between the coating and pipe is not excessively disturbed.

As mentioned earlier, the heating temperatures and time will depend on the natures of the coating and the heating element or elements. Epoxy plastic coatings have been used for coating of pipe in a wide number of applications. Other plastics both thermosetting and thermoplastic may be used for pipe coating. For example, the coating material referred to as SCOTCH COAT 202 is an effective pipe coating material which is applied to and bonded to the pipe by a melt-in process, the material being applied in powder form with the pipe heated to approximately 600° F. (316° C.). The material bonds relatively well to the pipe wall exterior and adequately protects the pipe metal. As an example of the method according to the invention, tests were run bending pipe coated with SCOTCH COAT 202 heated to a series of temperatures below the temperature of 600° F. (316° C.) at which the coating was applied to the pipe. It was found that bending could be accomplished with the coating heated to any temperature between about 250° F. (121° C.) and about 400° F. (205° C.), the preferred bending temperature for the coating being in the range from about 300° F. (149° C.) to about 400° F. (205° C.). For other materials, the preferred heating temperature will be in a range where the coating is significantly softened but is not caused to be deformed or destroyed by the heating, and where, after the coating is allowed to cool, the coating will be in its original condition.

Bends made in pipes for pipeline use may be from very slight bends of less than one degree per arc foot of pipe up to about ten degrees per arc foot of pipe. The pipe must be somewhat overbent to achieve a permanent bend of a certain bending radius. For example, to achieve a permanent bend of one degree per arc foot of pipe, the pipe would have to be bent to about two degrees per arc foot of pipe, the pipe resiliently returning to a bend of one degree per arc foot of pipe upon release by the bending machine die pressures. For sharper bends, the degree of overbending is proportionally less, and to achieve a permanent bend of, for example, ten degrees per arc foot of pipe, the pipe might have to be bent by the bending machine to an arc of about fifteen degrees per arc foot of pipe. In the tests, pipe coated with SCOTCH COAT 202 was permanently bent in bends as sharp as fifteen degrees per arc foot of pipe without rupture or tearing of the coating, or separation of the coating from the pipe, with heating of the coating to the temperatures in the aforesaid range. Similar tests on heat softenable coatings of various types produced similar satisfactory results.

Figure 8:
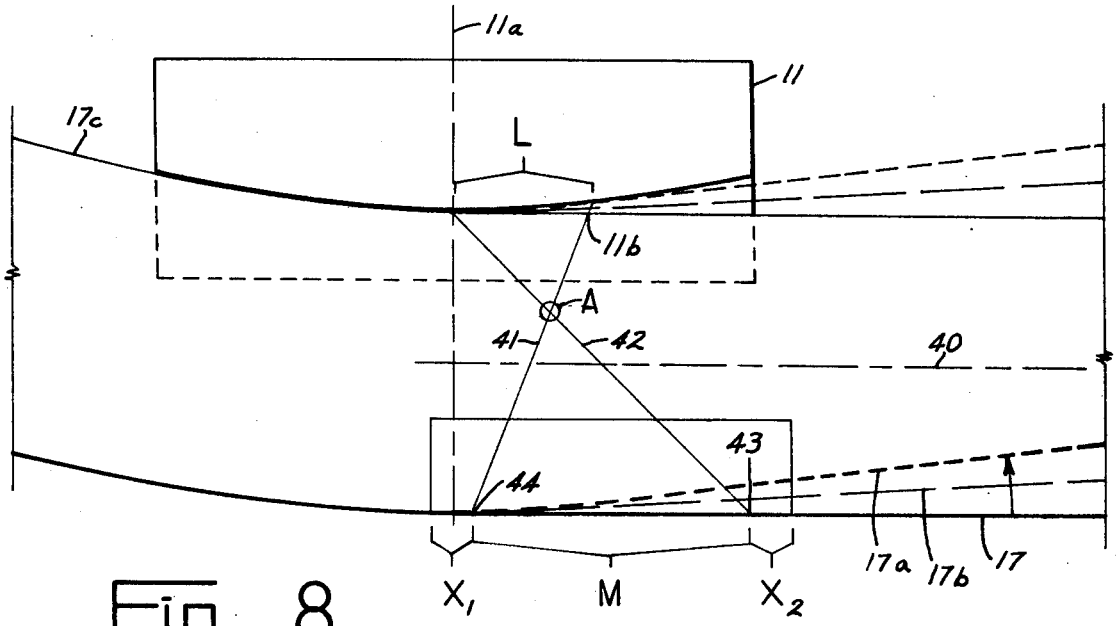
FIG. 8 is a schematic illustration showing a method for locating heating apparatus on a die surface, according to the invention.
Figure 9:
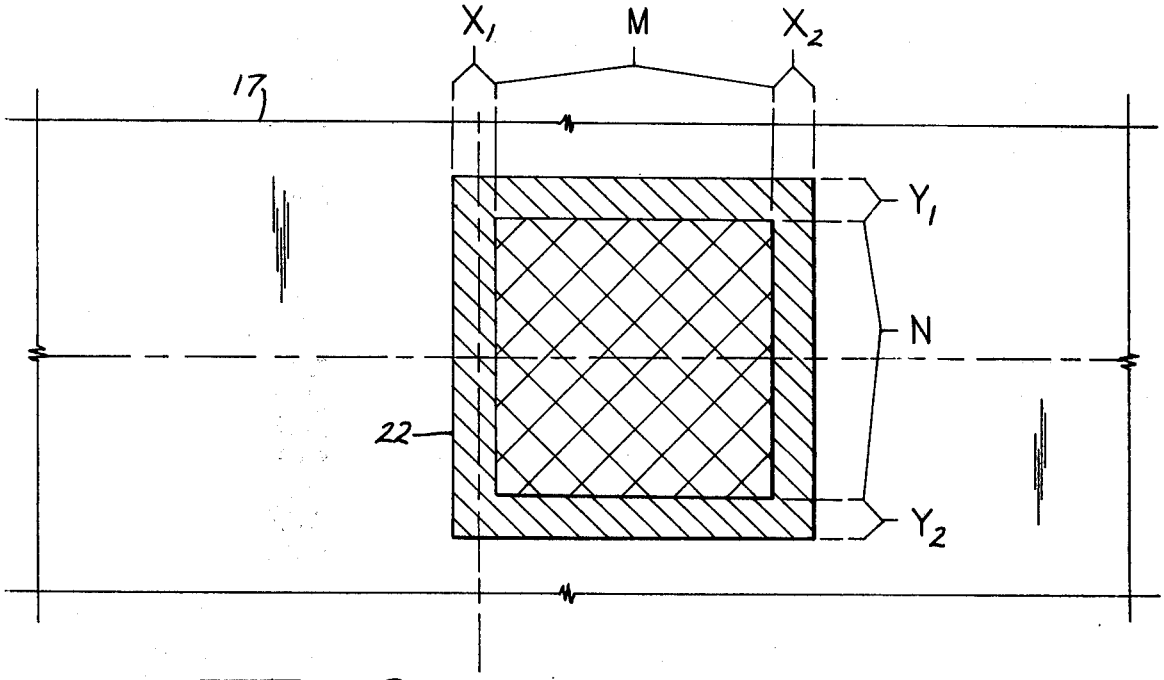
FIG. 9 is a schematic illustration further showing the method shown in FIG. 8.

In order that uniform results may be obtained in bending pipe without damage to the pipe coating, and in order that the methods and apparatus may be efficient and dependable without excess expenditure of electrical energy, the invention provides a method for selection of the pipe coating area which must be heated. Referring now to FIGS. 8 and 9 of the drawings, the methods for selection of the heating area will be explained. During the forming of a bend, which will usually be a single bend of a series of adjacent bends along the length of a pipe, the bending die 11 is engaged by the pipe 17 from the centerline 11*a* of the bending die to a point 11*b* spaced to the right of the centerline by a length L. The location of point 11*b* depends on the degree of bending, the location being closer to centerline 11*a* for bends of relatively lesser magnitude and being farther from centerline 11*a* for bends of relatively greater magnitude. Therefore, the length L from the centerline 11*a* depends on the degree of bending.

When the pipe 17 is bent, the pipe bends about a transverse axis A which is located above the axis 40 of the pipe. Axis A is the neutral point of the bend, where neither compression nor tension occurs during bending of the pipe. Above axis A, the pipe metal and coating are compressed by the bending operation, and below axis A, the pipe and coating are tensioned by the bending operation. The length of the underneath coating area which is most severely stressed during bending may, according to the invention, be determined by drawing lines 41 and 42 from the opposite ends of length L through axis A, and extending each line to its intersection with the exterior of the pipe at the bottom of the pipe at points 43 and 44, respectively. The length M between points 43 and 44 is the length of the greatest tensioning stress of the pipe mental and the coating along the bottom of the pipe when the pipe is bent. Length M is shorter for bends of relatively lesser magnitude and is longer for bends of relatively greater magnitude.

In FIG. 9, the lower half of the outer surface of the pipe, indicated by reference numeral 46, is shown flattened out from its actual semi-cylindrical form to be in a flat plane. The length of coating area which must be heated is indicated as length M, and the width of the coating area which must be heated is indicated as width N, extending about 60° upwardly around each side of the pipe from the bottom of the pipe.

In order to further insure that coating damage will not occur when the pipe is bent, it is preferred that the heater area be extended at each of its ends and at each of its sides by the lengths $X_1$, $X_2$ and $Y_1$, $Y_2$, respectively, each of these length extensions being about three to six inches in length. Heating of larger areas is not necessary to protect the pipe coating, and would result in increased heater cost and increased cost for electrical power to operate the heater.

In designing the apparatus, the length L should be selected to correspond to the sharpest bends to be made with the bending machine.

The upper surface 47 of heater 22 is preferably a smooth metal surface so that longitudinal movements of the pipe thereover will not cause damage to the heater.

The invention as described is very effective for use in bending coated pipe with satisfactory results. The heating should be accomplished fairly rapidly. It has been found that heating periods of long duration produce less satisfactory results in that the coating may be to some extent broken down. The breaking down of epoxy coating when heating of the coating is maintained for too long a period of time is probably caused by excessive polymerization, causing brittleness of the coating material, the epoxy coatings including accelerator and non-epoxy materials which react with the epoxy to create cross polymenization when the materials are heated. Therefore, control of the heating temperature and heating period will be necessary to realize the full benefits of the method and apparatus according to the invention.

While preferred embodiments of the method and apparatus according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Method for bending pipe having a coating of heat-softenable material bonded to its exterior surface in a pipe bending machine of the type having a downwardly facing bending die and an upwardly facing pin up shoe and an upwardly facing strongback, comprising placing an electrical resistance heater over an area of the strongback extending longitudinally of the strongback at least between the downward projections through the bend axis of the pipe of the ends of the longitudinal extent of the bending die which is engaged by the pipe during formation of a maximal bend in the pipe and extending laterally of the strongback at least about sixty degrees around the pipe to each side of the longitudinal botton centerline of the pipe, disposing a pipe to be bent in the bending machine between the bending die and the pinup shoe and strongback, operating the electrical resistance heater to heat and soften the area of the pipe coating corresponding thereto, and operating the pipe bending machine to pivotally move the strongback to force the pipe against the bending die over said longitudinal extent thereof to form a bend in the pipe, the coating stretching at said heated and softened area thereof whereby the coating is not damaged as said bend in the pipe is formed.

2. Method according to claim 1, wherein the longitudinal and lateral extents of said electrical resistance heater are extended in each direction by between about two inches and about six inches.

3. Method according to claim 1, wherein said pipe coating is an epoxy pipe coating.

4. Method according to claim 3, wherein said pipe coating is heated to a temperature between about 250° F. (121° C.) and about 400° F. (205° C.).

5. Method according to claim 4, wherein the longitudinal and lateral extents of said electrical resistance heater are extended in each direction by between about two inches and about six inches.

6. Method for bending pipe coated at its exterior with a heat-softenable coating material in a pipe bending machine of the type having an upper bending die against which the pipe is bent and which is downwardly relieved in a form to engage a pipe bent identically upwardly at the opposite sides of the centerline of the die, and having a pin up shoe for supporting one end of the pipe, and having a strongback which is moved pivotally to move the other end of the pipe upwardly to force a portion of the pipe against the bending die to form a bend, without damage to the pipe coating caused by bending stresses, comprising placing an electrical resistance heater over a portion of the pipe engaging surface of the strongback having an area thereof extending laterally around the pipe from the bottom line of the pipe upwardly at least about sixty degrees at each side of the pipe, the extent of the electrical resistance heater longitudinally of the pipe being between the angularly downward projections through the bend axis of the pipe of the ends of a line along the longitudinal centerline of the bending die extending from the longitudinal centerline of the bending die to the terminal length of the bending die contacted by the pipe when the bend is made, placing a pipe to be bent to engage the bending die at its said centerline and to engage the pin up shoe at said one end of the pipe and to engage the strongback and the electrical resistance heater on the strongback, operating the electrical resistance heater to heat and soften the pipe coating over the area of the electrical resistance heater, and operating the pipe bending machine to move the strongback to force said portion of the pipe against the bending die to form a bend in the pipe, the pipe coating stretching during the forming of the bend to be undamaged after the bend is formed.

7. The combination of claim 6, wherein the longitudinal and lateral extents of said electrical resistance heater are extended in each direction by between about two inches and about six inches.

8. The combination of claim 6, wherein said pipe coating is an epoxy pipe coating.

9. The combination of claim 8, wherein said pipe coating is heated to a temperature between about 250° F. (121° C.) and about 400° F. (205° C.).

10. The combination of claim 7, wherein the longitudinal and lateral extents of said electrical resistance heater are extended in each direction by between about two inches and about six inches.

11. Pipe bending apparatus for use in bending coated pipe, comprising a pipe bending machine including a pin up shoe, a bending die and a strongback, said strongback having an electrical resistance heater means disposed to cover an area thereof extending laterally of the coated pipe to be bent at least about 60° to each side of a longitudinal line along the bottom center of the pipe and extending longitudinally of the pipe at least from the intersection with said strongback of a first line disposed from one end of the portion of the bending die against which the pipe is forced by the strongback during bending of the pipe through the bending axis of the pipe and the intersection with said strongback of a second line disposed from the other end of said bending die portion through said bending axis of the pipe, and means for electrically energizing said electrical resistance heater means whereby the area of the coating on the pipe which is disposed against said electrical resistance heater means may be heated prior to bending of the pipe to soften the coating to prevent damage thereto during bending of the pipe.

12. The combination of claim 11, wherein said electrical resistance heater means is capable of heating the coating to a temperature of at least about 250° F. (121° C.).

13. The combination of claim 11, wherein said electrical resistance heater means is capable of heating the coating to a temperature between about 250° F. (121° C.) and about 400° F. (205° C.).

14. The combination of claim 11, said electrical resistance heater means being of flat flexible form capable of being bent to have the curvature of the pipe, said strongback having an upwardly facing cylindrically curved surface adapted to receive the lower pipe surface thereagainst, and said electrical resistance heater means being disposed flatly upon said strongback surface.

15. The combination of claim 14, wherein said electrical resistance heater means is capable of heating the coating to a temperature of at least about 250° F. (121° C.).

16. The combination of claim 14, wherein said electrical resistance heater means is capable of heating and coating to a temperature between about 250° F. (121° C.) and about 400° F. (205° C.).

17. The combination of claim 14, said strongback surface having a recess having a depth substantially equal to the thickness of said electrical resistance heater means, and said electrical resistance heater means being disposed in said recess with its pipe engaging side substantially flush with the surrounding portion of said strongback surface.

18. The combination of claim 17, wherein said electrical resistance heater means is capable of heating the coating to a temperature of at least about 250° F. (121° C.).

19. The combination of claim 17, wherein said electrical resistance heater means is capable of heating the coating to a temperature between about 250° F. (121° C.) and about 400° F. (205° C.).

20. The combination of claim 17, including means for controlling the temperature to which said electrical resistance heater means heats said pipe coating.

21. The combination of claim 20, said pipe engaging side of said electrical resistance heater means being in the form of a metal plate, whereby pipe movements thereagainst will not damage said electrical resistance heater means.

22. The combination of claim 21, said electrical resistance heater means comprising a plurality of resistance heaters of flat strip form disposed parallely side by side and each having connection to said electrical energizing means, said resistance heaters of flat strip form each being independently replaceable.

23. The combination of claim 11, said electrical resistance heater means comprising a plurality of resistance heaters of flat strip form disposed parallely side by side and each having connection to said electrical energizing means, said resistance heaters of flat strip form each being independently replaceable.

24. The combination of claim 11, said strongback surface having a recess having a depth substantially equal to the thickness of said electrical resistance heater means, and said electrical resistance heater means being disposed in said recess with its pipe engaging side substantially flush with the surrounding portion of said strongback surface.

* * * * *

UNITED STATES PATENT OFFICE

CERTIFICATE OF CORRECTION

PATENT NO. : 4,132,104

DATED : 1- 2-79

INVENTOR(S) : EDWARD A. CLAVIN

It is certified that error appears in the above-identified patent and that said Letters Patent are hereby corrected as shown below:

Column 2, line 40, change "postion" to -- position --.

Column 3, line 1, change "being" to -- bringing --.

Column 5, line 59, change "mental" to -- metal --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*